US011231210B2

(12) United States Patent
Mizuno et al.

(10) Patent No.: US 11,231,210 B2
(45) Date of Patent: Jan. 25, 2022

(54) STACK TYPE HEAT EXCHANGER

(71) Applicant: DENSO CORPORATION, Kariya (JP)

(72) Inventors: Yasuhiro Mizuno, Kariya (JP); Isao Tamada, Kariya (JP); Hiroshi Mieda, Kariya (JP); Ryohei Sugimura, Kariya (JP)

(73) Assignee: DENSO CORPORATION, Kariya (JP)

( * ) Notice: Subject to any disclaimer, the term of this patent is extended or adjusted under 35 U.S.C. 154(b) by 367 days.

(21) Appl. No.: 16/307,108

(22) PCT Filed: Mar. 23, 2017

(86) PCT No.: PCT/JP2017/011787
§ 371 (c)(1),
(2) Date: Dec. 4, 2018

(87) PCT Pub. No.: WO2017/212743
PCT Pub. Date: Dec. 14, 2017

(65) Prior Publication Data

US 2019/0226731 A1 Jul. 25, 2019

(30) Foreign Application Priority Data

Jun. 7, 2016 (JP) ..... JP2016-113808

(51) Int. Cl.
*F25B 39/04* (2006.01)
*F28D 9/02* (2006.01)
(Continued)

(52) U.S. Cl.
CPC ..... *F25B 39/04* (2013.01); *F28D 9/005* (2013.01); *F28D 9/0043* (2013.01); *F28D 9/02* (2013.01);
(Continued)

(58) Field of Classification Search
CPC ..... F28F 3/00; F28F 3/04; F28F 3/042; F28F 3/048; F28F 3/08; F28F 3/086; F28F 9/02;
(Continued)

(56) References Cited

U.S. PATENT DOCUMENTS 8,167,029 B2 * 5/2012 Bertilsson ..... F28D 9/005 165/167
2001/0030043 A1 * 10/2001 Gleisle ..... F28F 3/10 165/167
(Continued)

FOREIGN PATENT DOCUMENTS

JP H09014793 A 1/1997
JP 2000193342 A 7/2000
(Continued)

*Primary Examiner* — Frantz F Jules
*Assistant Examiner* — Daniel C Comings
(74) *Attorney, Agent, or Firm* — Harness, Dickey & Pierce, P.L.C.

(57) ABSTRACT

A stack type heat exchanger includes a plurality of first plates and a plurality of second plates. At least one of the respective first plates and the respective second plates has a protrusion protruding from a main body of the first plate or the second plate toward a first flow path, the protrusion being located at a peripheral portion of a tank space in the first flow path. The first plate and the second plate are joined to each other through the protrusion. The protrusion has a top portion and a side wall portion. A part of the side wall portion adjacent to the tank space has a thick structure portion, an entire thickness of the thick structure portion being thick in a direction perpendicular to the stacking direction.

13 Claims, 8 Drawing Sheets

(51) Int. Cl.

| | |
|---|---|
| ***F28F 3/00*** | (2006.01) |
| ***F28F 3/04*** | (2006.01) |
| ***F28F 3/08*** | (2006.01) |
| ***F28D 9/00*** | (2006.01) |

(52) U.S. Cl.
CPC ..... *F28F 3/04* (2013.01); *F28F 3/08* (2013.01); *F28D 9/0037* (2013.01)

(58) Field of Classification Search
CPC .... F28D 9/0031; F28D 9/0037; F28D 9/0043; F28D 9/005; F25B 39/04
See application file for complete search history.

(56) References Cited

U.S. PATENT DOCUMENTS

| | | | | |
|---|---|---|---|---|
| 2005/0082049 | A1* | 4/2005 | Brost ..... | F28D 9/005 165/166 |
| 2012/0118548 | A1 | 5/2012 | Han et al. | |
| 2012/0234523 | A1 | 9/2012 | Jouanny et al. | |
| 2015/0292803 | A1* | 10/2015 | Nyander ..... | B23P 15/26 165/166 |
| 2016/0010929 | A1 | 1/2016 | Takahashi et al. | |

FOREIGN PATENT DOCUMENTS

| | | | |
|---|---|---|---|
| JP | 2003222494 | A | 8/2003 |
| JP | 2012207809 | A | 10/2012 |
| JP | 2012533726 | A | 12/2012 |
| JP | 2014109388 | A | 6/2014 |
| JP | 2014163639 | A | 9/2014 |
| JP | 2015059669 | A | 3/2015 |

* cited by examiner

STACK TYPE HEAT EXCHANGER

CROSS REFERENCE TO RELATED APPLICATIONS

This application is a U.S. National Phase Application under 35 U.S.C. 371 of International Application No. PCT/JP2017/011787 filed on Mar. 23, 2017. This application is based on and claims the benefit of priority from Japanese Patent Application No. 2016-113808 filed on Jun. 7, 2016. The entire disclosures of all of the above applications are incorporated herein by reference.

TECHNICAL FIELD

The present disclosure relates to a stack type heat exchanger.

BACKGROUND ART

Patent Document 1 discloses a stack type heat exchanger in which heat is exchanged between refrigerant of a refrigerating cycle and heat medium. The heat exchanger includes a plurality of plates stacked with each other. A refrigerant flow path through which a refrigerant flows and a heat medium flow path through which a heat medium flows are formed by the plurality of plates. The refrigerant flow path and the heat medium flow path are alternately arranged in the stacking direction of the plurality of plates. The heat exchanger has a refrigerant tank space connected to each of the refrigerant flow paths. The refrigerant tank space is defined by communication holes formed in the respective plates.

PRIOR ART LITERATURES

Patent Literature

Patent Document 1: JP 2015-59669 A

SUMMARY OF INVENTION

The high-pressure refrigerant discharged from a compressor of the refrigerating cycle collects and flows in the refrigerant tank space. For this reason, a stress directed from the inside to the outside of the refrigerant tank space is applied to the heat exchanger in the stacking direction of the plurality of plates. Then, a stress is applied to the two plates forming the refrigerant flow path to separate the two plates from each other. Due to the stress, breakage occurs at a joining portion of the two plates.

When a refrigerant fin is arranged in the refrigerant flow path between the two plates, the refrigerant fin is joined to the two plates. In this case, the stress in the direction to separate the two plates from each other is concentrated on a portion of the refrigerant fin on the side of the refrigerant tank space. Due to this stress concentration, the refrigerant fin is ruptured. Further, breakage occurs at a joining portion of the two plates.

As described above, a conventional stack type heat exchanger has an issue that the pressure withstanding strength against the refrigerant is insufficient.

The present inventors study providing a protrusion protruding toward the refrigerant flow path in each of the plurality of plates, at a location adjacent to the refrigerant tank space in the refrigerant flow path. The tops of the protrusions are joined between the two plates forming one refrigerant flow path. According to this, the protrusion receives the stress in the direction separating the two plates. Therefore, it is possible to improve the pressure withstanding strength of the heat exchanger against the refrigerant, compared with a case where the protrusion is not provided.

However, in this case, a tensile stress concentrates on a part of the side wall portion of the protrusion adjacent to the refrigerant tank space. The inventors discover an issue that the side wall portion breaks depending on the magnitude of the concentrated tensile stress, and the refrigerant leaks. It should be noted that the above-mentioned issue occurs in a stack type heat exchanger in which heat is exchanged between a first fluid and a second fluid, and the pressure of the first fluid is higher than that of the second fluid. In other words, the above-mentioned issue occurs in a stack type heat exchanger in which heat is exchanged between a first fluid and a second fluid having a pressure lower than that of the first fluid.

The present disclosure aims to further improve the pressure withstanding strength of the stack type heat exchanger against the first fluid.

According to an aspect of the present disclosure, a stack type heat exchanger includes a plurality of first plates, and a plurality of second plates.

The first plate and the second plate are alternately stacked with each other, a first flow path is defined between the second plate and the first plate adjacent to the second plate on one side in the stacking direction of the first plate and the second plate, a first fluid flowing through the first flow path, and a second flow path is defined between the second plate and the first plate adjacent to the second plate on the other side in the stacking direction, a second fluid flowing through the second flow path, a pressure of the second fluid being lower than that of the first fluid.

Each of the plurality of first plates has: a first main body that partitions the first flow path and the second flow path; and a first communicating hole formed in the first main body to define a tank space by which the first flow paths adjacent to each other through the second flow path communicate with each other in the stacking direction.

Each of the plurality of second plates has: a second main body that partitions the first flow path and the second flow path; and a second communicating hole formed in the second main body to define the tank space.

At least one of the respective first plates and the respective second plates has a protrusion protruding from at least one of the first main body and the second main body toward the first flow path, the protrusion being located at a peripheral portion of the tank space in the first flow path, and the first plate and the second plate are joined to each other through the protrusion.

The protrusion has a top portion which is a joining portion between the first plate and the second plate, and a side wall portion which is continuous with the top portion, the side wall portion being located between the top portion and the main body in the stacking direction, and a part of the side wall portion adjacent to the tank space has a thick structure portion, an entire thickness of the thick structure portion in a direction perpendicular to the stacking direction being thicker than a thickness of a partition part that partitions the first flow path and the second flow path in each of the first main body and the second main body.

Accordingly, the tensile strength of the side wall portion can be improved compared with a case where the thick structure portion is not formed on a part of the side wall portion adjacent to the tank space. Therefore, it is possible to further improve the pressure withstanding strength of the stack type heat exchanger with respect to the first fluid.

According to another aspect of the present disclosure, a stack type heat exchanger includes a plurality of first plates, and a plurality of second plates.

The first plate and the second plate are alternately stacked with each other, a first flow path is defined between the second plate and the first plate adjacent to the second plate on one side in the stacking direction of the first plate and the second plate, a first fluid flowing through the first flow path, and a second flow path is defined between the second plate and the first plate adjacent to the second plate on the other side in the stacking direction, a second fluid flowing through the second flow path, a pressure of the second fluid being lower than that of the first fluid.

Each of the plurality of first plates has: a first main body that partitions the first flow path and the second flow path; a first communicating hole formed in the first main body to define a tank space by which the first flow paths adjacent to each other through the second flow path communicate with each other in the stacking direction; and a first tube portion extending from a peripheral edge of the first communicating hole toward the one side in the stacking direction.

Each of the plurality of second plates has: a second main body that partitions the first flow path and the second flow path; a second communicating hole formed in the second main body to define the tank space; and a second tube portion extending from a peripheral edge of the second communicating hole toward the other side in the stacking direction.

The second tube portion of the second plate and the first tube portion of the first plate adjacent to the second plate on the other side in the stacking direction overlap with each other at overlapping portions, the tank space being formed by joining the overlapping portions to each other.

The respective first plate has a protrusion protruding from at least one of the first main body and the second main body toward the first flow path, the protrusion being located at a peripheral portion of the tank space in the first flow path, and the first plate and the second plate are joined to each other through the protrusion.

The protrusion has a top portion which is a joining portion between the first plate and the second plate, and a side wall portion which is continuous with the top portion, the side wall portion being located between the top portion and the main body in the stacking direction.

Each of the plurality of first plates and each of the plurality of second plates are made of a metal material, and a part of the side wall portion adjacent to the tank space is connected to the second tube portion and joined to a part of the first tube portion through a brazing material.

Accordingly, it is possible to improve the tensile strength of the side wall portion, compared with a case where a part of the side wall portion is not joined to a part of the first tube portion. Therefore, it is possible to further improve the pressure withstanding strength of the stack type heat exchanger with respect to the first fluid.

DESCRIPTION OF EMBODIMENTS

Figure 1:
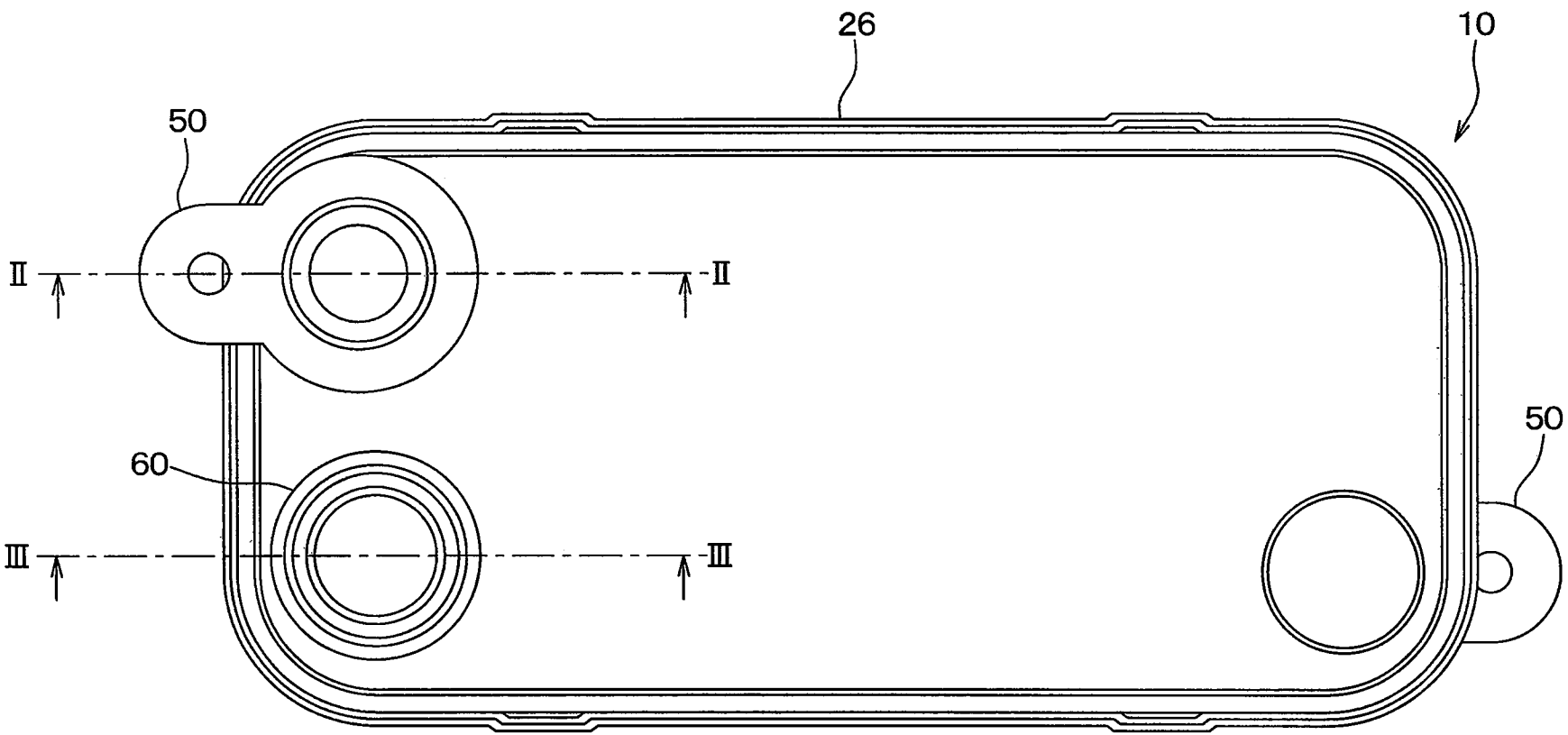
FIG. 1 is a plan view of a heat exchanger according to a first embodiment.

Hereinafter, embodiments of the present disclosure will be described with reference to the drawings. In the following embodiments, the same or equivalent parts are explained with the same reference numeral.

First Embodiment

Figure 2:
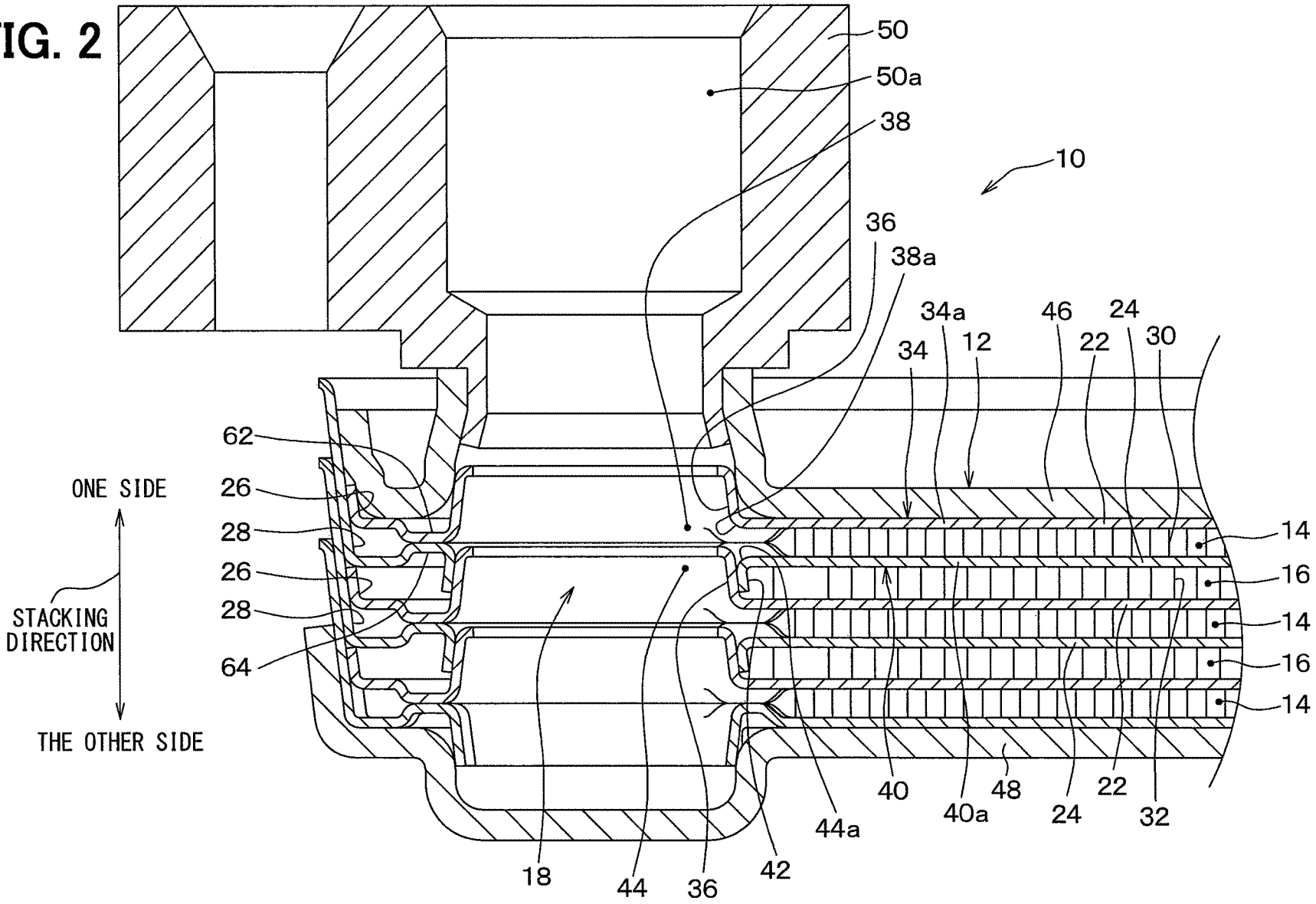
FIG. 2 is a cross-sectional view taken along a line II-II in FIG. 1.
Figure 3:
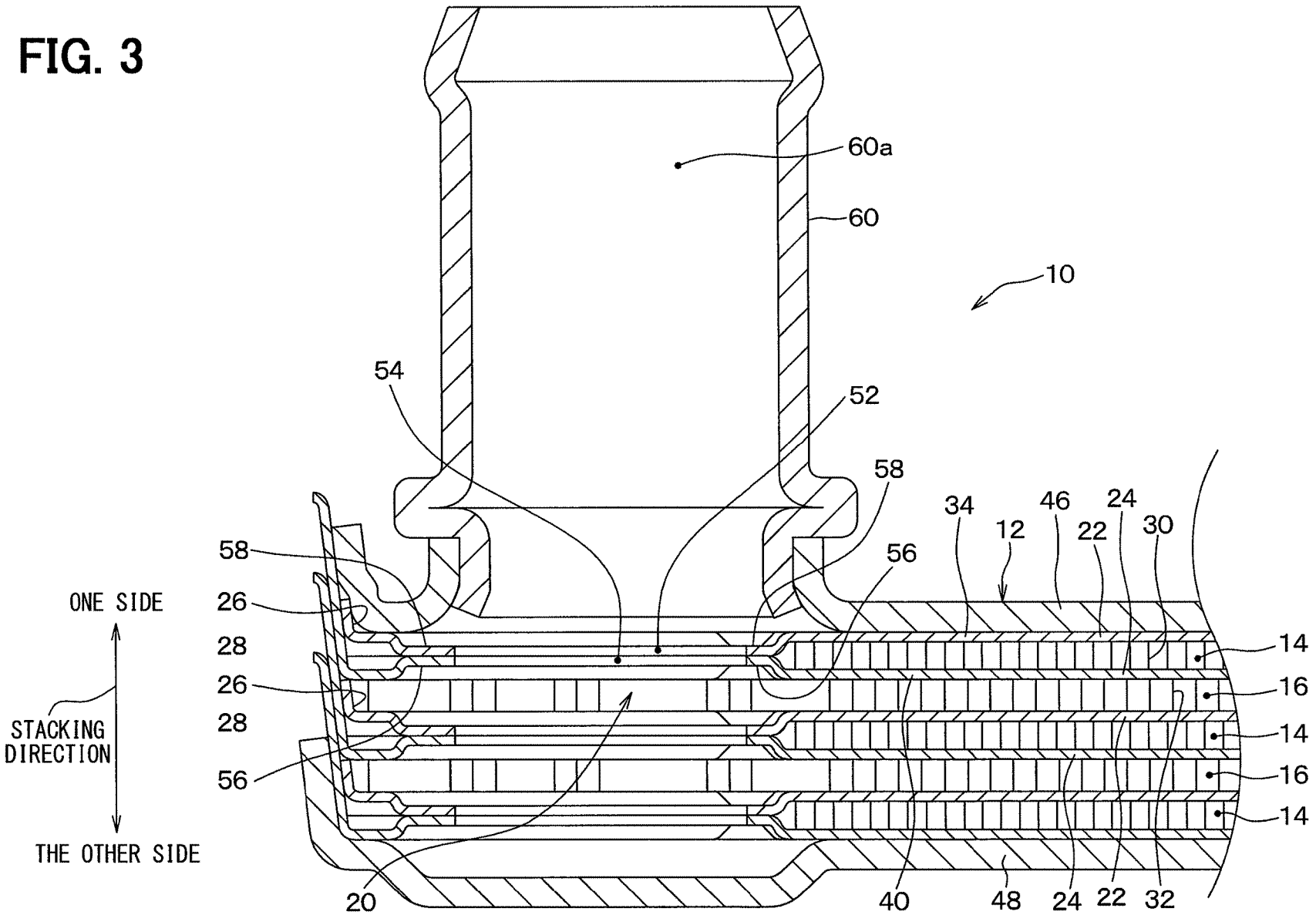
FIG. 3 is a cross-sectional view taken along a line III-III in FIG. 1.

A heat exchanger 10 of the present embodiment shown in FIGS. 1 to 3 is a radiator for a refrigeration cycle. The heat exchanger 10 makes the refrigerant of the refrigeration cycle to emit heat by heat exchange between the refrigerant as a first fluid and cooling water as a second fluid. The refrigerant discharged from a compressor of the refrigeration cycle has a higher pressure than the refrigerant sucked into the compressor. Therefore, the refrigerant flowing inside the heat exchanger 10 has the pressure higher than a pressure of the cooling water.

As shown in FIGS. 2 and 3, the heat exchanger 10 includes plural plates 12 stacked with each other. The plates 12 are made of a metal material. The plates 12 are joined by brazing. The plates 12 form plural refrigerant flow paths 14, plural cooling water flow paths 16, two refrigerant tank spaces 18, and two cooling water tank spaces 20.

The plates 12 of the heat exchanger 10 comprise plural inner plates 22 and plural outer plates 24. The inner plate 22 and the outer plate 24 are formed into shapes as shown in the drawings by press working. The inner plate 22 corresponds to a first plate. The outer plate 24 corresponds to a second plate.

The inner plate 22 and the outer plate 24 are alternately stacked with each other. In a state where the inner plate 22 and the outer plate 24 are alternately stacked, one inner plate 22 is positioned inside one outer plate 24. Hereinafter, the stacking direction of the inner plate 22 and the outer plate 24 is simply referred to as the stacking direction.

One inner plate 22 has a first outer peripheral wall 26 extending toward one side in the stacking direction. The first outer peripheral wall 26 is positioned over the entire outer circumference of the inner plate 22. One outer plate 24 has a second outer peripheral wall 28 extending toward one side in the stacking direction. The second outer peripheral wall 28 is positioned over the entire outer circumference of the outer plate 24. The first outer peripheral wall 26 is located inside the second outer peripheral wall 28, between one outer plate 24 and one inner plate 22 adjacent to the outer plate 24 on one side in the stacking direction.

A first space is formed between one outer plate 24 and one inner plate 22 adjacent to the outer plate 24 on one side in the stacking direction. The first outer peripheral wall 26 and the second outer peripheral wall 28 have overlapping portions that overlap with each other. The overlapping portions are joined with each other through a brazing metal. Thus, the first space is tightly sealed. The first space is the refrigerant flow path 14 through which the refrigerant flows. The refrigerant flow path 14 corresponds to a first flow path.

A second space is formed between one outer plate 24 and one inner plate 22 adjacent to the outer plate 24 on the other side in the stacking direction. The second outer peripheral wall 28 of the outer plate 24 and the second outer peripheral wall 28 of another outer plate 24 positioned on the other side in the stacking direction are joined with each other at overlapping portions. As a result, the second space is tightly sealed. The second space is the cooling water flow path 16 through which the cooling water flows. The cooling water flow path 16 corresponds to a second flow path.

As described above, in the heat exchanger 10, the plural inner plates 22 and the plural outer plates 24 defines the refrigerant flow paths 14 and the cooling water flow paths 16. In the heat exchanger 10, the refrigerant flow paths 14 and the cooling water flow paths 16 are alternately arranged in the stacking direction.

A refrigerant fin 30 for promoting heat exchange between the refrigerant and the cooling water is disposed in the refrigerant flow path 14. The refrigerant fin 30 is joined to the adjacent inner plate 22 and the adjacent outer plate 24. A cooling water fin 32 for promoting heat exchange between the refrigerant and the cooling water is disposed in the cooling water flow path 16. The cooling water fin 32 is joined to the adjacent inner plate 22 and the adjacent outer plate 24.

As shown in FIG. 2, one inner plate 22 has a first main body 34 and a first tube portion 36. The first main body 34 is a portion surrounded by the first outer peripheral wall 26. The first main body 34 has a partition part 34*a* that partitions the refrigerant flow path 14 and the cooling water flow path 16. The first main body 34 has a first communicating hole 38 for refrigerant to define a refrigerant tank space 18. The first tube portion 36 extends from a peripheral edge 38*a* of the first communicating hole 38 in the first main body 34 to one side in the stacking direction. The inside of the first tube portion 36 communicates with the first communicating hole 38.

One outer plate 24 has a second main body 40 and a second tube portion 42. The second main body 40 is a portion surrounded by the second outer circumferential wall 28. The second main body 40 has a partition part 40*a* that partitions the refrigerant flow path 14 and the cooling water flow path 16. The second main body 40 has a second communicating hole 44 for the refrigerant to define the refrigerant tank space 18. The second tube portion 42 extends from a peripheral edge 44*a* of the second communicating hole 44 in the second main body 40 to the other side in the stacking direction. The inside of the second tube portion 42 communicates with the second communicating hole 44.

The second tube portion 42 of one outer plate 24 and the first tube portion 36 of one inner plate 22 adjacent to the outer plate 24 on the other side in the stacking direction have overlapping portions overlapping each other. The overlapping portions are joined with each other through a brazing material. Thereby, a communication space is formed through which the adjacent refrigerant flow paths 14 communicate with each other across the cooling water flow path 16 in the stacking direction. The communication space is not in communication with the cooling water flow path 16. This communication space is the refrigerant tank space 18. The refrigerant tank space 18 functions as a distributor that distributes the refrigerant to the plural refrigerant flow paths 14 or a collector that collects the refrigerant flowing out of the plural refrigerant flow paths 14.

The plural plates 12 of the heat exchanger 10 comprise one first outer wall plate 46 and one second outer wall plate 48. The first outer wall plate 46 is located at one end of the heat exchanger 10 in the stacking direction. The second outer wall plate 48 is located at the other end of the heat exchanger 10 in the stacking direction. The first outer wall plate 46 and the second outer wall plate 48 are reinforcing members for securing the strength of the heat exchanger 10. The first outer wall plate 46 and the second outer wall plate 48 are thicker than the inner plate 22 and the outer plate 24.

The heat exchanger 10 has a connection block 50. The connection block 50 is a connection member for connecting the heat exchanger 10 and the refrigerant piping. The connecting block 50 is attached to the opening of the first outer wall plate 46. The internal space 50*a* of the connection block 50 communicates with the refrigerant tank space 18. A part of the second outer wall plate 48 constitutes a lid of the refrigerant tank space 18, on the side opposite to the connection block 50 through the refrigerant tank space 18.

As shown in FIG. 3, the first main body 34 of one inner plate 22 has a first communicating hole 52 for the cooling water to define the cooling water tank space 20. The second main body 40 of one outer plate 24 has a second communicating hole 54 for the cooling water to define the cooling water tank space 20.

In a state where the first communicating hole 52 and the second communicating hole 54 communicate with each other, the outer plate 24 and one inner plate 22 adjacent to the outer plate 24 on one side in the stacking direction are joined with each other. Thereby, a communication space is formed such that the adjacent cooling water flow paths 16 through the refrigerant flow path 14 are communicated with each other in the stacking direction. This communication space is not in communication with the refrigerant flow path 14. This communication space is the cooling water tank space 20. The cooling water tank space 20 functions as a distributor that distributes the cooling water to the plural cooling water flow paths 16 or a collector that collects the cooling water flowing out of the plural cooling water flow paths 16.

Figure 4:
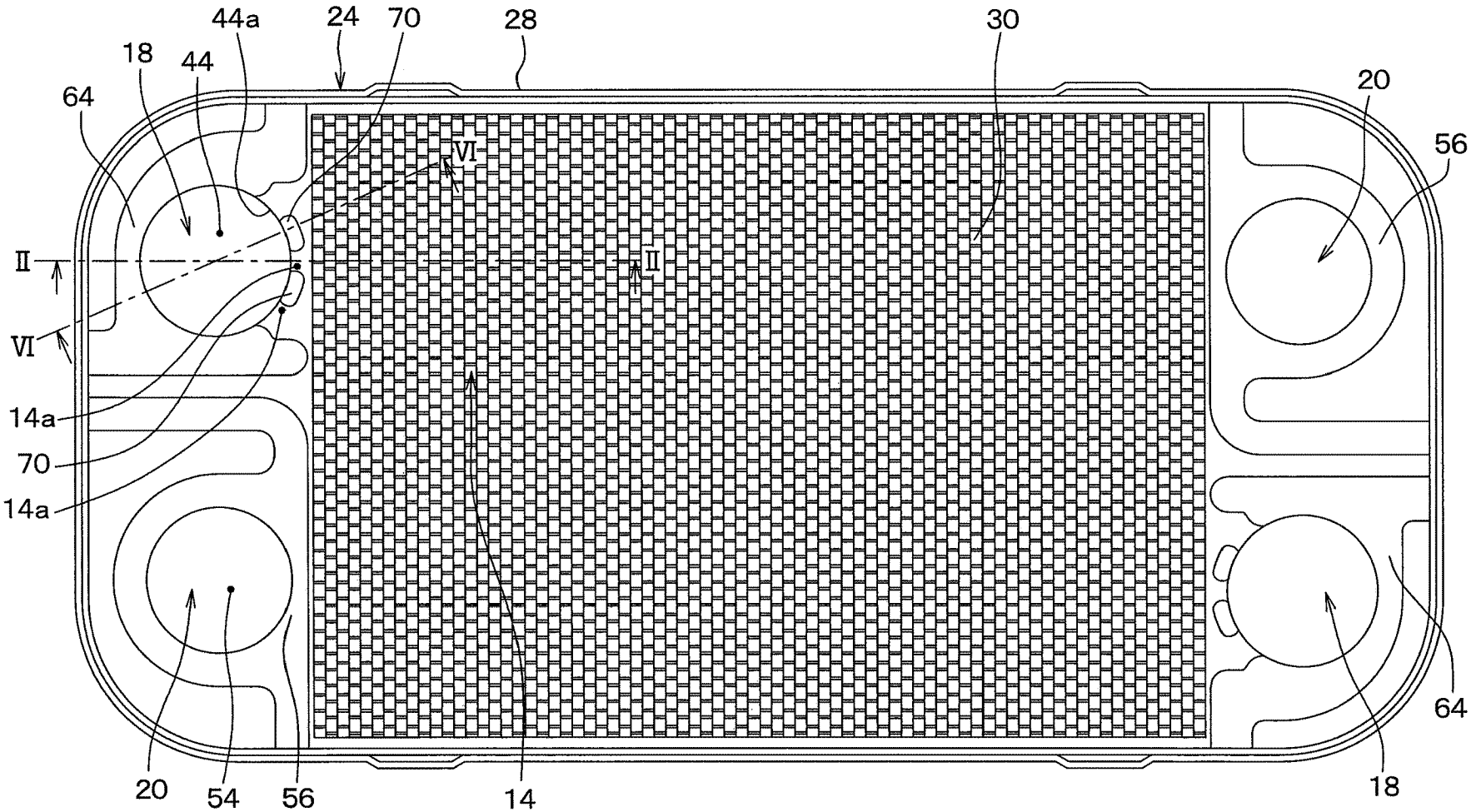
FIG. 4 is a plan view of an outer plate and a refrigerant fin of the heat exchanger of the first embodiment.

Specifically, a joining portion 56 is provided around the second communicating hole 54 of one outer plate 24. A joining portion 58 is provided around the first communicating hole 52 of one inner plate 22 adjacent to the outer plate 24 on one side in the stacking direction. The joining portion 56 and the joining portion 58 are joined through a brazing material. As shown in FIG. 4, the joining portion 56 is disposed in the entire area around the second communicating hole 54. Although not shown, the joining portion 58 is disposed in the entire area around the first communicating hole 52 similarly to the joining portion 56.

As shown in FIG. 3, the heat exchanger 10 is provided with a cooling water pipe 60. The cooling water pipe 60 is a connecting member for connecting the heat exchanger 10 and the cooling water piping. The cooling water pipe 60 is attached to the opening of the first outer wall plate 46 provided at a position different from the connecting block 50. The internal space 60*a* of the cooling water pipe 60 communicates with the cooling water tank space 20.

Figure 5:
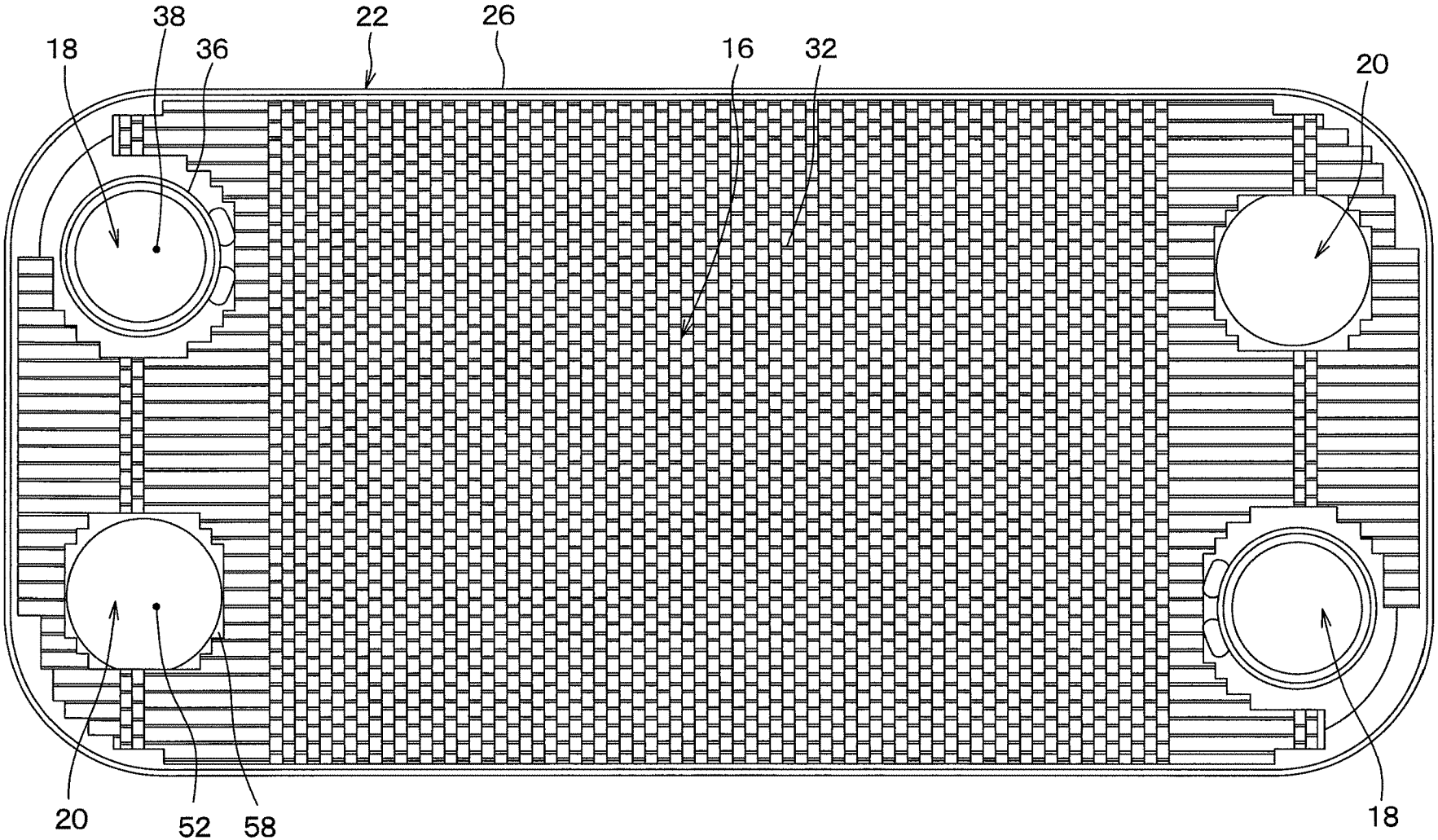
FIG. 5 is a plan view of an inner plate and a cooling water fin of the heat exchanger of the first embodiment.

As shown in FIGS. 4 and 5, two refrigerant tank spaces 18 and two cooling water tank spaces 20 are disposed at the four corners of the plate 22, 24 respectively. The two refrigerant tank spaces 18 are arranged at two corners positioned diagonally of the four corners. Likewise, the two cooling water tank spaces 20 are arranged at two other corners located diagonally of the four corners.

The refrigerant flowing into one of the two refrigerant tank spaces 18 is distributed to the plural refrigerant flow paths 14. The refrigerant flowing through the plural refrigerant flow paths 14 flows and gathers in the other of the two refrigerant tank spaces 18. The cooling water flowing into one of the two cooling water tank spaces 20 is distributed to the plural cooling water flow paths 16. The cooling water flowing through the plural cooling water flow paths 16 flows and gathers in the other of the two cooling water tank spaces 20. When the refrigerant flows through the refrigerant flow paths 14, heat is exchanged between the refrigerant and the cooling water.

As shown in FIG. 2, the inner plate 22 has a joining portion 62 around the refrigerant tank space 18, and the outer plate 24 has a joining portion 64 around the refrigerant tank space 18. The joining portion 62 and the joining portion 64 are joined to each other through a brazing material. The joining portion 62, 64 partition the refrigerant flow path 14 connected to the refrigerant tank space 18. The joining portion 62, 64 is arranged in a half or more of the entire periphery of the refrigerant tank space 18 except a part around the refrigerant tank space 18. In the present embodiment, as shown in FIG. 4, the joining portion 64 is disposed about ¾ of the entire periphery of the refrigerant tank space 18. Like the joining portion 64, the joining portion 62 is disposed about ¾ of the entire periphery of the refrigerant tank space 18. Therefore, as shown in FIG. 4, in either of the two refrigerant tank spaces 18, the refrigerant tank space 18 and the refrigerant flow path 14 are connected only in a part of the periphery of the refrigerant tank space 18. In the present embodiment, the pressure withstanding strength of the heat exchanger 10 against the refrigerant is ensured also by the joining portions 62 and 64.

As shown in FIG. 4, the outer plate 24 has two protrusions 70. The two protrusions 70 are located between the refrigerant tank space 18 and the refrigerant fin 30 in the refrigerant flow path 14. That is, the two protrusions 70 are located close to the second communicating hole 44 in the second main body 40. In the present embodiment, the two protrusions 70 are adjacent to the second communicating hole 44.

The two protrusions 70 are arranged as an island shape in the refrigerant flow path 14, such that the protrusion 70 is an island surrounded by the refrigerant. In other words, each of the two protrusions 70 is arranged to divide the refrigerant flow path 14 into plural flow paths 14*a*.

Figure 6:
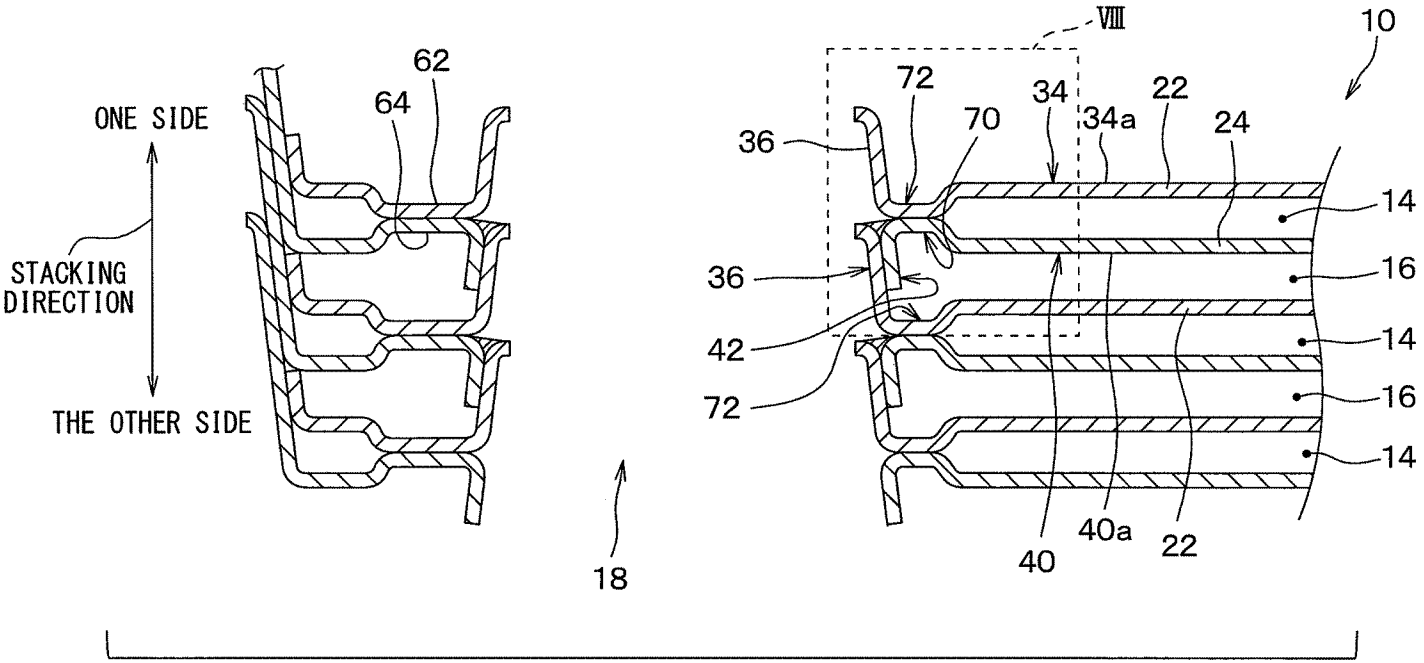
FIG. 6 is a cross-sectional view of the heat exchanger taken along a line VI-VI in FIG. 4.

As shown in FIG. 6, the two protrusions 70 protrude toward one side in the stacking direction. In FIG. 6, the refrigerant fins 30 and the cooling water fins 32 are not shown. The two protrusions 70 are defined by bending the second main body 40. The second main body 40 is bent so that the second main body 40 is projected to one side in the stacking direction. This bent shape is formed by press working of the outer plate 24.

The inner plate 22 has two protrusions 72 protruding toward the other side in the stacking direction. Each of the two protrusions 72 is disposed at a position facing each of the two protrusions 70 in the stacking direction. The two protrusions 72 are defined by bending the first main body 34, like the two protrusions 70.

The protrusion 70 and the protrusion 72 are joined with each other through a brazing material, between the outer plate 24 and the inner plate 22 adjacent to the outer plate 24 on one side in the stacking direction. That is, the inner plate 22 and the outer plate 24 are joined to each other through the protrusions 70, 72.

Figure 7:
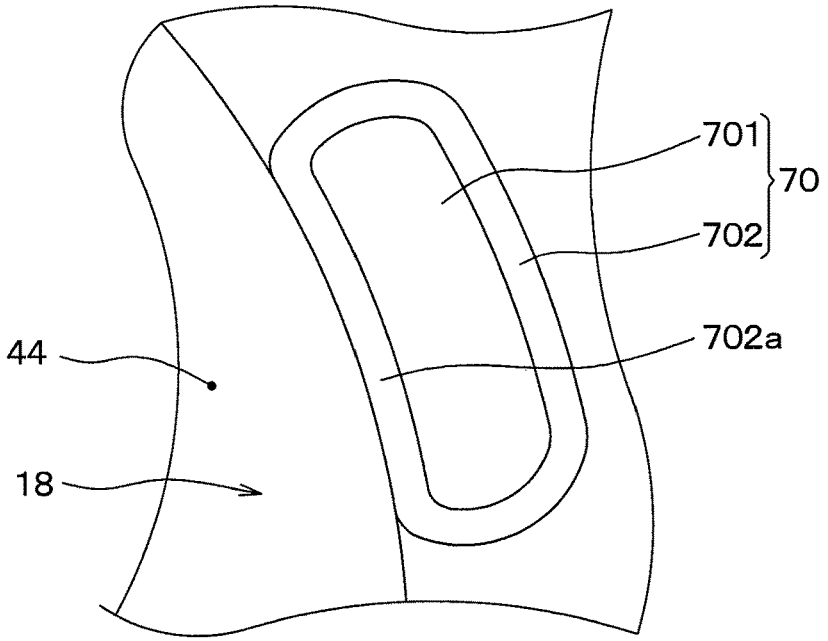
FIG. 7 is an enlarged view of a protrusion in FIG. 4.
Figure 8:
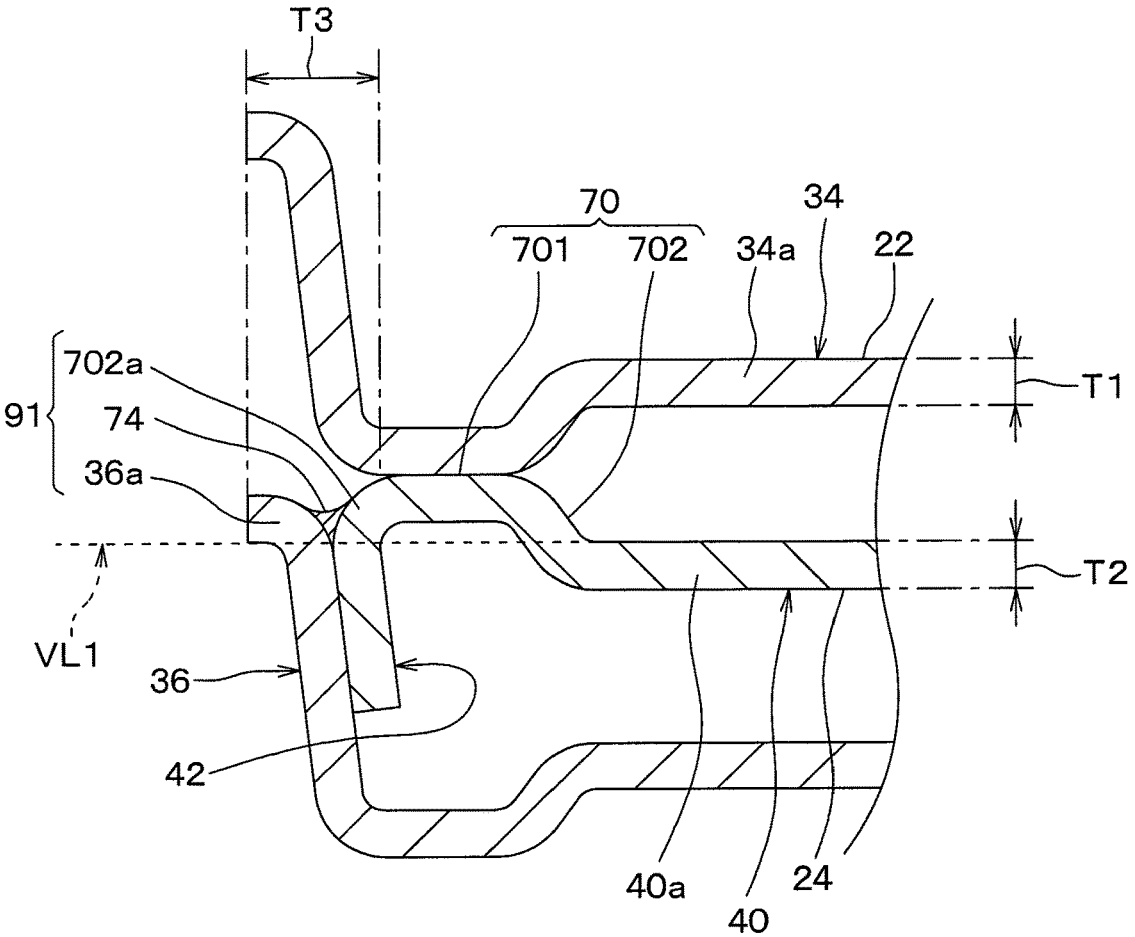
FIG. 8 is an enlarged view of a portion VIII in FIG. 7.

As shown in FIGS. 7 and 8, the protrusion 70 has a top portion 701 and a side wall portion 702. The top portion 701 is a joining portion with the protrusion 72. The side wall portion 702 is continuous to the periphery of the top portion 701. The side wall portion 702 has a tube shape that surrounds the top portion 701. The side wall portion 702 is located between the top portion 701 and the second main body 40 in the stacking direction. That is, the side wall portion 702 is located on one side in the stacking direction with respect to an imaginary line VL1. The imaginary line VL1 is a line indicating a position of a surface of the partition part 40*a* of the second main body 40 in the stacking direction.

As shown in FIG. 8, a part 702*a* of the side wall portion 702 adjacent to the refrigerant tank space 18 is continuous with the second tube portion 42. No step is formed between the part 702*a* and the second tube portion 42. The part 702*a* is opposed to the first tube portion 36 in a direction perpendicular to the stacking direction. The part 702*a* is joined to a part 36*a* of the first tube portion 36 through the brazing material 74, that is, the fillet 74. As a result, a thick structure portion 91 is formed on the part 702*a* of the side wall portion 702. The thick structure portion 91 is defined by the part 702*a*, the fillet 74 in contact with the part 702*a*, and the part 36*a* of the first tube portion 36 in contact with the fillet 74. The thick structure portion 91 has an entire thickness T3 in the direction perpendicular to the stacking direction. The entire thickness T3 is larger than the thickness T1 of the partition part 34*a* of the first body 34, and is larger than the thickness T2 of the partition part 40*a* of the second body 40.

In contrast to the heat exchanger 10 of the present embodiment, if the protrusion 70, 72 is not provided, the stress in the direction to separate the inner plate 22 and the outer plate 24 from each other concentrates a portion of the refrigerant fin 30 adjacent to the refrigerant tank space 18. The refrigerant fin 30 may be broken by the stress concentration.

According to the heat exchanger 10 of the present embodiment, the protrusions 70 and 72 are provided and joined. Accordingly, the protrusions 70, 72 joined with each other receive the stress in the direction separating the inner plate 22 and the outer plate 24 apart. Therefore, it is possible to improve the pressure resistance strength of the heat exchanger 10 with respect to the refrigerant, as compared with a case where the protrusions 70 and 72 are not provided.

When the protrusion is provided, a tensile stress due to the pressure of the refrigerant flowing through the refrigerant tank space concentrates on a part of the side wall portion of the protrusion adjacent to the refrigerant tank space. Therefore, if the thick structure portion 91 of the present embodiment is not formed on the part of the side wall portion, depending on the magnitude of the tensile stress, the side wall portion breaks and the refrigerant leaks.

According to the heat exchanger 10 of the present embodiment, the thick structure portion 91 is formed on the part 702*a* of the side wall portion 702. Therefore, the tensile strength of the side wall portion 702 is improved as compared with a case where the thick structure portion 91 is not formed and the part 702*a* of the side wall portion 702 is not reinforced. Therefore, according to the heat exchanger 10 of the present embodiment, the pressure resistance strength against the refrigerant can be further improved.

Second Embodiment

Figure 9:
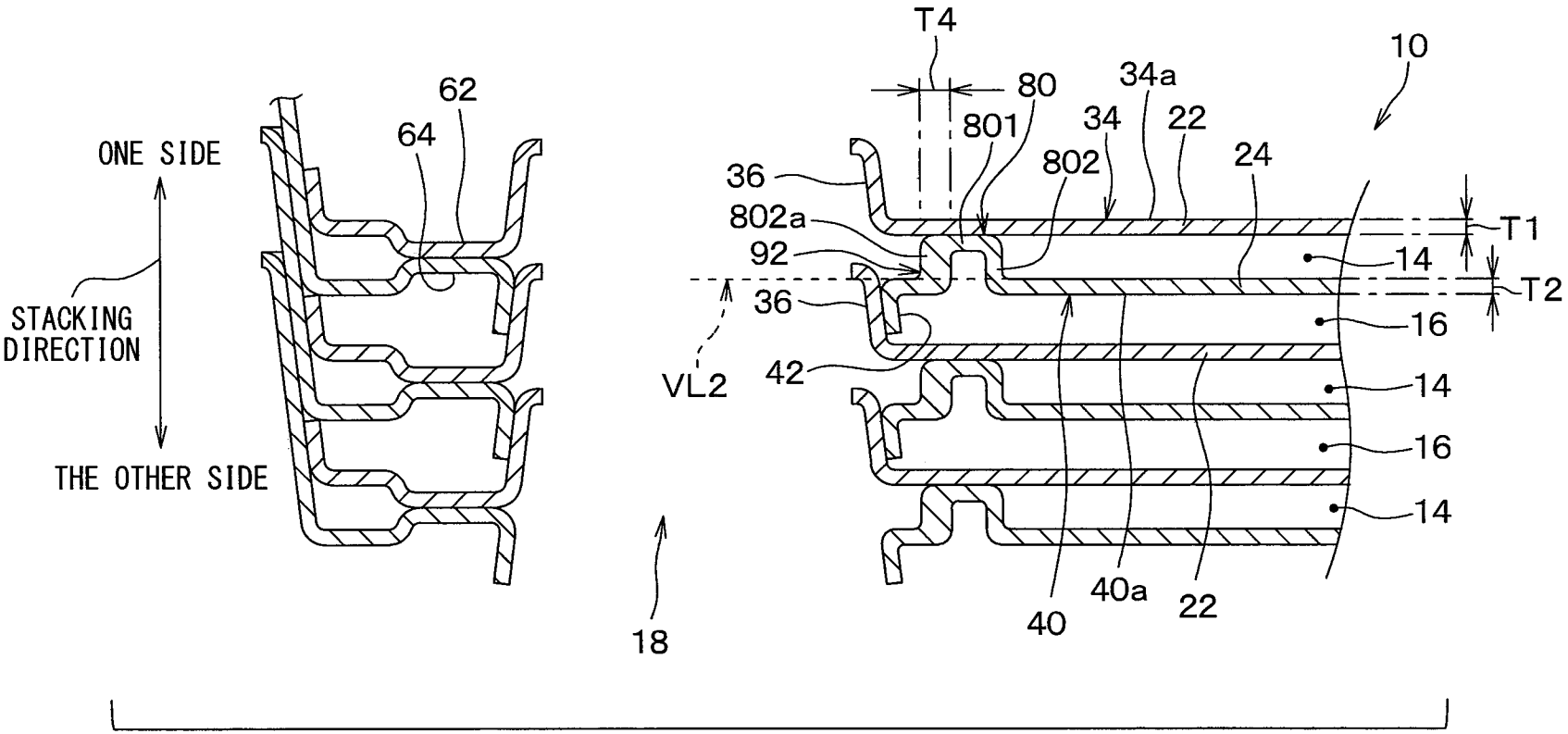
FIG. 9 is a cross-sectional view, corresponding to FIG. 6, of a heat exchanger according to a second embodiment.

The heat exchanger 10 of the present embodiment shown in FIG. 9 differs from the heat exchanger 10 of the first embodiment in that the inner plate 22 does not have the protrusion 72, and that the outer plate 24 has the protrusion 80 instead of the protrusion 70. Other configurations of the heat exchanger 10 are the same as those of the heat exchanger 10 of the first embodiment. In FIG. 9, the illustration of the refrigerant fin 30 and the cooling water fin 32 are omitted.

The protrusion 80 is disposed away from the refrigerant tank space 18. In other words, the protrusion 80 is disposed away from the second tube portion 42 in a direction intersecting with the stacking direction. The inner plate 22 and the outer plate 24 are joined to each other through the protrusion 80.

The protrusion 80 has a top portion 801 and a side wall portion 802. The top portion 801 is a joining portion joined with the inner plate 22. The side wall portion 802 is continuous to the periphery of the top portion 801. The side wall portion 802 has a tube shape that surrounds the top portion 801. The side wall portion 802 is positioned closer to the top portion 801 than the second main body 40 in the stacking direction. That is, the side wall portion 802 is located on one side of the imaginary line VL2 in the stacking direction. The imaginary line VL 2 is a line indicating the position of the surface of the partition part 40*a* of the second main body 40 in the stacking direction.

In the present embodiment, unlike the first embodiment, a part 802*a* of the side wall portion 802 adjacent to the refrigerant tank space 18 is not connected to the second cylinder portion 42. A step is formed between the part 802*a* and the second tube portion 42. The plate thickness T4 of the part 802*a* is thicker than the plate thickness T2 of the partition part 40*a*. As a result, a thick structure portion 92 is formed by the part 802*a* of the side wall portion 802. The entire thickness T4 of the thick structure portion 92 in the direction perpendicular to the stacking direction is larger than each of the plate thickness T1 of the partition part 34*a* of the first main body 34 and the plate thickness T2 of the partition part 40*a* of the second main body 40.

Also in the present embodiment, the thick structure portion 92 is formed. Therefore, the tensile strength of the side wall portion 802 is improved, compared with a case where the part 802*a* of the side wall portion 802 has the same thickness as that of the partition part 40*a*. Therefore, with the heat exchanger 10 of the present embodiment as well, it is possible to further improve the pressure resistance strength against the refrigerant.

Other Embodiment

The present disclosure is not limited to the above-described embodiments, and it is possible to appropriately change the scope within the appended claims as described below.

(1) In the first embodiment, the outer plate 24 has two protrusions 70, but is not limited thereto. The number of the protrusions 70 may be one or three or more. Likewise, although the inner plate 22 has the two protrusions 72, it is not limited thereto. The number of the protrusions 72 may be one or three or more.

(2) In the first embodiment, the heat exchanger 10 has both the protrusion 70 of the outer plate 24 and the protrusion 72 of the inner plate 22, but is not limited thereto. The heat exchanger 10 may have only one of the protrusion 70 and the protrusion 72.

(3) In the first embodiment, the thick structure portion 91 is formed on the protrusion 70 of the outer plate 24, but is not limited thereto. The protrusion 72 of the inner plate 22 may have a thick structure portion. A thick structure portion may be formed on both of the protrusion 70 and the protrusion 72. Similarly, in the second embodiment, the thick structure portion 92 is formed on the protrusion 80 of the outer plate 24, but is not limited thereto. A thick structure portion may be formed on the protrusion formed only on the inner plate 22. Further, a thick structure portion may be formed on each protrusion of both the inner plate 22 and the outer plate 24.

(4) In each of the above embodiments, the heat exchanger 10 is provided with the refrigerant fins 30 and the cooling water fins 32, but is not limited thereto. The heat exchanger 10 may not have the refrigerant fin 30 and the cooling water fin 32.

(5) In each of the above-described embodiments, the cooling water is used as the second fluid, but a fluid other than the cooling water may be used, such as air.

(6) In each of the above embodiments, the heat exchanger 10 is used as a radiator, but is not limited thereto. The heat exchanger 10 may be used for other purposes, such as an oil cooler for cooling engine oil. Heat is exchanged in the oil cooler between the engine oil as a first fluid and a second fluid having a pressure lower than that of engine oil, such as cooling water or air. As another example, the heat exchanger 10 may be used an EGR cooler for cooling the EGR gas. The EGR gas is used for EGR (Exhaust Gas Recirculation) system and is recirculated to the intake passage connected to the engine. Heat is exchanged in the EGR cooler between the EGR gas as the first fluid and the second fluid having a lower pressure than the EGR gas.

The present disclosure is not limited to the embodiments and can be modified within the scope of the present disclosure. The present disclosure may also be varied in many ways, and such variations and the equivalency are within the scope of the disclosure. The embodiments above are not irrelevant to one another and can be combined appropriately unless a combination is obviously impossible. In the respective embodiments above, elements forming the embodiments are not necessarily essential unless specified as being essential or deemed as being apparently essential in principle. In a case where a reference is made to the components of the respective embodiments as to numerical values, such as the number, values, amounts, and ranges, the components are not limited to the numerical values unless specified as being essential or deemed as being apparently essential in principle. Also, in a case where a reference is made to the components of the respective embodiments above as to shapes and positional relations, the components are not limited to the shapes and the positional relations unless explicitly specified or limited to particular shapes and positional relations in principle.

CONCLUSION

According to the first aspect represented by a part or all of the above embodiments, a stack type heat exchanger includes: a plurality of first plates; and a plurality of second plates. At least one of the respective first plates and the respective second plates has a protrusion protruding from at least one of the first main body and the second main body toward the first flow path, the protrusion being located at a peripheral portion of the tank space in the first flow path. The first plate and the second plate are joined to each other through the protrusion. The protrusion has a top portion and a side wall portion. A part of the side wall portion adjacent to the tank space has a thick structure portion, an entire thickness of the thick structure portion in a direction perpendicular to the stacking direction being thicker than a thickness of a partition part that partitions the first flow path and the second flow path in each of the first main body and the second main body.

Further, according to the second aspect, a fin is disposed in the first flow path to facilitate heat exchange between the first fluid and the second fluid, the fin being joined to the first plate and the second plate adjacent to each other. The peripheral portion of the tank space in the first flow path is defined between the tank space and the fin in the first flow path.

In the case where the protrusion is not provided, stress in a direction to separate the first plate and the second plate from each other is concentrated on a part of the fin adjacent to the tank space. Due to this stress concentration, breakage of the fin occurs. Therefore, the configuration of the first aspect is particularly effective when the fin is arranged in the first flow path. That is, according to the configuration of the first aspect, the fracture of the fin can be suppressed.

According to the third aspect, each of the plurality of first plates has a first tube portion extending from a peripheral edge of the first communicating hole toward the one side in the stacking direction, and each of the plurality of second plates has a second tube portion extending from a peripheral edge of the second communicating hole toward the other side in the stacking direction. The second tube portion of the second plate and the first tube portion of the first plate adjacent to the second plate on the other side in the stacking direction overlap with each other at overlapping portions, the tank space being formed by joining the overlapping portions to each other. Each of the plurality of second plates has the protrusion. Each of the plurality of first plates and each of the plurality of second plates are made of a metal material. The part of the side wall portion is connected to the second tube portion and joined to the first tube portion through a brazing material. The thick structure portion is defined by the part of the side wall portion, the brazing material in contact with the part of the side wall portion, and a part of the first tube portion in contact with the brazing material. In this way, it is preferable to form the thick structure portion.

The invention claimed is:

1. A stack heat exchanger comprising:

a plurality of first plates; and a plurality of second plates, wherein a first flow path is defined between one of the plurality of second plates and one of the plurality of first plates adjacent to one of the plurality of second plates on one side in the stacking direction of one of the plurality of first plates and one of the plurality of second plates, a first fluid flowing through the first flow path, a second flow path is defined between the one of the plurality of second plates and another one of the plurality of first plates adjacent to the one of the plurality of second plates on an other side in the stacking direction, a second fluid flowing through the second flow path, a pressure of the second fluid being lower than a pressure of the first fluid, each of the plurality of first plates has:

a first main body that defines the first flow path and the second flow path; and a first communicating hole formed in the first main body to define a tank space by which the first flow paths adjacent to each other through the second flow path communicate with each other in the stacking direction, each of the plurality of second plates has:

a second main body that defines the first flow path and the second flow path; and a second communicating hole formed in the second main body to define the tank space, at least one of the plurality of first plates and one of the plurality of second plates has a protrusion protruding from at least one of the first main body and the second main body toward the first flow path, the protrusion being located at a peripheral portion of the tank space in the first flow path, the one of the plurality of first plates and the one of the plurality of second plates are joined to each other through the protrusion, each protrusion has a top portion which is a joining portion between one of the plurality of first plates and one of the plurality of second plates, and a side wall portion which is continuous with the top portion, the side wall portion being located between the top portion and the main body in the stacking direction, a part of the side wall portion adjacent to the tank space has a thick structure portion, an entire thickness of the thick structure portion in a direction perpendicular to the stacking direction being thicker than a thickness of a partition part that partitions the first flow path and the second flow path in each of the first main body and the second main body, each of the plurality of first plates has a first tube portion extending toward the one side in the stacking direction, each of the plurality of second plates has a second tube portion extending toward the other side in the stacking direction, the second tube portion of one of the plurality of second plates and the first tube portion of one of the plurality of first plates directly adjacent to one of the plurality of second plates on the other side in the stacking direction overlap with each other at overlapping portions, the tank space being formed by joining the overlapping portions to each other, each of the plurality of second plates has the protrusion, each of the plurality of first plates and each of the plurality of second plates are made of a metal material, the part of the side wall portion is connected to the second tube portion and joined to the first tube portion through a brazing material, the thick structure portion is defined by the part of the side wall portion, the brazing material in contact with the part of the side wall portion, and a part of the first tube portion in contact with the brazing material, and the thick structure portion is located adjacent to a joining portion at which a top portion of the protrusion of the first plate and a top portion of the protrusion of the second plate are joined to each other.

2. The stack heat exchanger according to claim 1, wherein a fin is disposed in the first flow path to facilitate heat exchange between the first fluid and the second fluid, the fin being joined to one of the plurality of first plates and one of the plurality of second plates adjacent to each other, and the peripheral portion of the tank space in the first flow path is defined between the tank space and the fin in the first flow path.

3. The stack heat exchanger according to claim 1, wherein one of the plurality of first plates has a first protrusion protruding from the first main body toward the first flow path, the first protrusion being located at a peripheral portion of the tank space in the first flow path, one of the plurality of second plates has a second protrusion protruding from the second main body toward the first flow path, the second protrusion being located at the peripheral portion of the tank space in the first flow path, and the first protrusion and the second protrusion are joined with each other through a brazing material.

4. The stack heat exchanger according to claim 3, wherein the second protrusion has a top portion joined with the second protrusion and a side wall portion continuous to a periphery of the top portion, the side wall portion has a tube shape that surrounds the top portion, and the side wall portion is located between the top portion and the second main body in the stacking direction.

5. The stack heat exchanger according to claim 3, wherein the second protrusion includes a first side wall portion, a top portion and a second side wall portion, the first side wall portion is located between the second main body and the top portion in the staking direction, the second side wall portion is continuous with the second tube portion, and the top portion is joined with and located between the first side wall portion and the second side wall portion.

6. The stack heat exchanger according to claim 5, wherein the first side wall portion extends upward from the second main body, and the second side wall portion extends downward from the top portion.

7. The stack heat exchanger according to claim 5, wherein the first side wall portion and the second side wall portion extend downward from the top portion.

8. A stack heat exchanger comprising:

a plurality of first plates; and a plurality of second plates, wherein a first flow path is defined between one of the plurality of second plates and one of the plurality of first plates adjacent to one of the plurality of second plates on one side in the stacking direction of one of the plurality of first plates and one of the plurality of second plates, a first fluid flowing through the first flow path, a second flow path is defined between the one of the plurality of second plates and another one of the plurality of first plates adjacent to the one of the plurality of second plates on an other side in the stacking direction, a second fluid flowing through the second flow path, a pressure of the second fluid being lower than a pressure of the first fluid, each of the plurality of first plates has:

a first main body that defines the first flow path and the second flow path;

a first communicating hole formed in the first main body to define a tank space by which the first flow paths adjacent to each other through the second flow path communicate with each other in the stacking direction; and a first tube portion extending toward the one side in the stacking direction, each of the plurality of second plates has:

a second main body that defines the first flow path and the second flow path;

a second communicating hole formed in the second main body to define the tank space; and a second tube portion extending toward the other side in the stacking direction, the second tube portion of one of the plurality of second plates and the first tube portion of one of the plurality of first plates directly adjacent to one of the plurality of second plates on the other side in the stacking direction overlap with each other at overlapping portions, the tank space being formed by joining the overlapping portions to each other, one of the plurality of first plates has a protrusion protruding from at least one of the first main body and the second main body toward the first flow path, the protrusion being located at a peripheral portion of the tank space in the first flow path, the one of the plurality of first plates and the one of the plurality of second plates are joined to each other through the protrusion, each protrusion has a top portion which is a joining portion between one of the plurality of first plates and one of the plurality of second plates, and a side wall portion which is continuous with the top portion, the side wall portion being located between the top portion and the main body in the stacking direction, each of the plurality of first plates and each of the plurality of second plates are made of a metal material, a part of the side wall portion adjacent to the tank space is connected to the second tube portion and joined to a part of the first tube portion through a brazing material, and a thick structure portion where the part of the side wall portion adjacent to the tank space connected to the second tube portion and joined to the part of the first tube portion through the brazing material is located adjacent to a joining portion at which a top portion of the protrusion of the first plate and a top portion of the second plate are joined to each other.

9. The stack heat exchanger according to claim 8, wherein one of the plurality of first plates has a first protrusion protruding from the first main body toward the first flow path, the first protrusion being located at a peripheral portion of the tank space in the first flow path, one of the plurality of second plates has a second protrusion protruding from the second main body toward the first flow path, the second protrusion being located at the peripheral portion of the tank space in the first flow path, and the first protrusion and the second protrusion are joined with each other through a brazing material.

10. The stack heat exchanger according to claim 9, wherein the second protrusion has a top portion joined with the second protrusion and a side wall portion continuous to a periphery of the top portion, the side wall portion has a tube shape that surrounds the top portion, and the side wall portion is located between the top portion and the second main body in the stacking direction.

11. The stack heat exchanger according to claim 9, wherein the second protrusion includes a first side wall portion, a top portion and a second side wall portion, the first side wall portion is located between the second main body and the top portion in the staking direction, the second side wall portion is continuous with the second tube portion, and the top portion is joined with and located between the first side wall portion and the second side wall portion.

12. The stack heat exchanger according to claim 11, wherein the first side wall portion extends upward from the second main body, and the second side wall portion extends downward from the top portion.

13. The stack heat exchanger according to claim 11, wherein the first side wall portion and the second side wall portion extend downward from the top portion.

* * * * *